United States Patent [19]

Slaats et al.

[11] Patent Number: 4,616,877

[45] Date of Patent: Oct. 14, 1986

[54] CHAIR WITH BACK HEIGHT ADJUSTMENT

[75] Inventors: Mathew A. Slaats; James E. Blesinger, both of Jasper, Ind.

[73] Assignee: Kimball International, Inc., Jasper, Ind.

[21] Appl. No.: 732,516

[22] Filed: May 9, 1985

[51] Int. Cl.[4] ..... A47C 1/00

[52] U.S. Cl. ..... 297/353; 297/410

[58] Field of Search ..... 297/353, 410; 248/423

[56] References Cited

U.S. PATENT DOCUMENTS

| | | | |
|---|---|---|---|
| 490,637 | 1/1893 | Butler | 297/353 X |
| 1,437,630 | 12/1922 | Zimmerli . | |
| 3,295,888 | 10/1965 | Poland . | |
| 3,326,602 | 5/1965 | Moore et al. . | |
| 3,526,430 | 11/1968 | Eldon, III . | |
| 3,698,765 | 10/1972 | Olsen | 297/410 X |
| 3,837,705 | 9/1974 | Marraccini . | |
| 4,036,525 | 7/1977 | Howk . | |
| 4,099,774 | 7/1978 | Sandham . | |
| 4,099,779 | 7/1978 | Goldner | 297/410 X |
| 4,221,430 | 9/1980 | Frobose . | |
| 4,384,742 | 5/1983 | Wisniewski . | |

FOREIGN PATENT DOCUMENTS

| | | | |
|---|---|---|---|
| 515802 | 12/1930 | Fed. Rep. of Germany . | |
| 2308483 | 9/1973 | Fed. Rep. of Germany | 297/353 |
| 2377177 | 1/1977 | France . | |
| 838665 | 6/1960 | United Kingdom | 297/353 |
| 1184067 | 10/1967 | United Kingdom . | |

*Primary Examiner*—Francis K. Zugel
*Assistant Examiner*—Peter R. Brown
*Attorney, Agent, or Firm*—Jeffers, Irish & Hoffman

[57] ABSTRACT

A chair having a tiltable back which is vertically adjustable into selected vertical positions. The adjustment mechanism includes rack and gear members which are selectively engagable to lock the back in selected vertical positions. The rack member is secured to a support column and the gear member is secured to the back. The back height adjustment mechanism permits the back to tilt about a first axis and to pivot about a second axis, to release the rack and gear members for vertically repositioning the chair back. When the bottom edge of the chair back is pulled forward, the gear teeth of the cooperating rack and gear members are disconnected thereby enabling vertical movement of the chair back. Upon release of the bottom edge of the chair back, a bias spring urges the rack members together to hold the chair back in the selected vertical position.

21 Claims, 8 Drawing Figures

CHAIR WITH BACK HEIGHT ADJUSTMENT

BACKGROUND OF THE INVENTION

This invention pertains to a chair, and more particularly to a chair used by secretaries, typists, etc., and having a concealed adjustment mechanism for adjusting the height of the chair back.

Generally, chairs having adjustable backs comprise a base, a seat supported by the base, a support member attached to the base and extending upwardly from the seat, and a back mounted on the support member. The back is generally movably secured to the support member so that the back can be adjusted vertically relative to the seat.

Chair back height adjustment mechanisms of prior art chairs have not been satisfactory since the backs have been difficult to adjust for the chair occupants. One example of such a prior art height adjustment mechanism is disclosed in U.S. Pat. No. 3,526,430. A concealed chair back height adjustment mechanism is disclosed wherein the occupant of the chair must pull forwardly on the top portion of the chair back in order to adjust the height of the chair back. Thus an occupant of the chair must reach over his shoulder to reach the top of the chair back and must then pull the chair back forwardly and simultaneously slide the back upwardly or downwardly to adjust it to a new position. It is inconvenient and uncomfortable for most people to assume the positions necessary to make these adjustments. Alternatively the occupant can leave the chair and adjust the back by pulling the top portion of the back forwardly and sliding the back to the new vertical position. The person must then reoccupy the chair to see if the back is adjusted to the proper height and, if further adjustment is needed, he must again leave the chair and repeat the procedure. What is therefore desired is to provide a chair height adjustment mechanism whereby the occupant of the chair can adjust the height of the back without leaving the chair. What is furthermore desired is to provide a chair back height adjustment mechanism whereby the chair back can be adjusted easily by a person occupying a chair.

Yet another problem with prior art height adjustment mechanisms for chair backs has been that when the chair is not occupied and someone pushes on the top of the chair back it is possible that the height of the chair back will be inadvertantly adjusted by the forward pressure on the top of the chair back. Such adjustments are of course undesirable. What is therefore desired is to provide a chair with an adjustable back wherein the back will retain its position despite application of forces to the top of the chair back.

Another problem with prior art adjustment mechanisms for chair backs has been that they are relatively complex and therefore relatively costly to manufacture. It is therefore desired to provide a chair back height adjustment mechanism which is simple and reliable and which is relatively inexpensive to manufacture.

A still further problem with prior art chair back height adjustment mechanism has been that they are exposed so that dust and dirt can collect on them and thereby prevent their proper preparation as well as make them unsightly. It is therefore desired to provide a height adjustment mechanism for a chair back which is concealed.

SUMMARY OF THE INVENTION

The present invention overcomes the disadvantages of the prior art chair back height adjustment mechanisms by providing a chair with an improved chair back height adjustment mechanism.

The present invention in one form thereof, comprises a chair having an adjustable back which is adjusted by moving the lower portion of the chair back forwardly and pivoting the chair back about a horizontal axis at the top of the chair back to unlock the adjustment mechanism. After adjustment of the height of the chair back the bottom portion of the chair back is allowed to resume its normal position thereby relocking the adjustment mechanism.

The chair back height adjustment mechanism of the present invention, in one form thereof, comprises a chair back support member and a chair back. The support member includes a member having projections thereon which are normally engaged with a second member, having mating slots therein and which is attached to the chair back. The chair back further includes a bias spring which normally urges the first and second members into locking engagement. Pivot members are secured to the top of the support member for pivotably supporting the back so that the chair back can pivot about a first horizontal axis located at the top of the chair back. When it is desired to adjust the height of the chair back, the lower edge of the chair back is pulled forwardly against the bias force of the spring. The first and second members will thereby be disengaged so that the height of the chair back can be adjusted, after which the first and second members are reengaged. The chair back is also pivotable about a second horizontal axis whereby the angle at which the chair back is tilted, self-adjusts.

The adjustment mechanism of the present invention in one form thereof is arranged to facilitate the vertical adjustment of the chair back by a person seated in the chair. The adjustment mechanism can be released by pulling the bottom of the chair back forward. The top portion of the chair back is pivotally attached to the top of a mounting assembly of the vertical adjustment mechanism. A gear member secured to the chair back is spring biased and extends through an opening in a panel member of the mounting assembly to contact a rack member attached to the chair support member. A sliding member of the adjustment mechanism is slidably mounted on the support member and is secured to the mounting assembly. When the bottom portion of the chair back is pulled forwardly against the spring bias force, the gear member is released from contact with the rack member and the chair back, mounting assembly and sliding member can slide vertically to another selected vertical position whereafter the gear and rack members are reengaged to maintain the back in the new position.

One advantage of the chair back adjustment mechanism of the present invention is that the chair back will not be undesirably adjusted when it encounters casual downward or forward forces applied to the top portion of the chair back. The chair back can be released for adjustment only by applying a forward force to the bottom portion of the chair back. A casual downward force applied to the top of the chair back neither releases the adjustment mechanism nor otherwise influences the vertical position of the chair back.

Another advantage of the chair back adjustment mechanism of the present invention is that it permits tilting of the chair back by providing a unique chair back mounting assembly having multiple pivot points. One pair of pivot points permits a pivoting movement of the chair back to unlock the adjustment mechanism in order to allow vertical repositioning of the chair back. A second pair of pivot points enables the chair back to be tilted without releasing the chair back adjustment mechanism.

Still another advantage of the adjustment assembly of the present invention is that it requires only a small spring to urge the locking members into engagement and to lock the adjustment mechanism and retain the back in a selected vertical position. The arrangement of the present invention therefore requires less force than prior art arrangements to overcome the spring bias force which urges the rack members into meshing engagement.

A further advantage of the adjustment mechanism of the present invention is that it permits convenient height adjustment of the chair back by a chair occupant and eliminates the need for awkward contorted reaching by the occupant and inconvenient vacating of the chair in order for the chair occupant to release the adjustment mechanism and to reposition the chair back.

A still further advantage of the present invention is that the adjustment mechanism is concealed thereby preventing dust and dirt from entering into the mechanism and preventing its proper operation.

Yet another advantage of the present invention is that the mechanism is of simple construction and is relatively inexpensive to manufacture while being reliable and efficient in operation.

The invention, in one form thereof, comprises a chair having a base, a seat, a support column connected to the base or seat, a carrier slidably connected to the column and a back panel. A first pivot is secured to an upper portion of the back panel for pivotally connecting the panel to the carrier for limited rotation about a first pivot axis and there is included a locking mechanism comprising a first locking element on the back panel selectively engageable with a second locking element on the support column when the panel is rotated about the first pivot axis to a lock position to thereby lock the panel and carrier in a selected vertical position. The first and second lock elements disengage when the panel is rotated about the first pivot axis to a release position wherein the panel and carrier can be moved vertically relative to the support column. A biasing device, such as a spring, is operatively associated with the panel for yieldably urging the panel toward its locked position to cause engagement of the first and second lock elements. A second pivot pivotally connects the carrier to the support column for rotation about the second pivot axis, the second pivot axis being located below the first axis and in proximity to the locking mechanism. The second pivot prevents disengagement of the locking mechanism when the back and carrier are rotated together, such as would occur when the occupant of the chair shifts his or her position or the chair is moved by grasping the upper edge of the back panel.

It is an object of the present invention to provide an improved chair back height adjustment mechanism wherein the chair back can be conveniently adjusted by a person while seated on the chair.

Another object of the present invention is to provide a chair having a tiltable and vertically adjustable chair back and wherein the chair back retains its desired vertical position while being tilted by a person seated in the chair so that undesired changes in the chair back height will be avoided.

A further object of the present invention is to provide a chair with a chair back adjustment mechanism that is simple, reliable, and efficient in operation.

A still further object of the present invention is to provide a chair with a chair back which is vertically adjustable by moving the lower edge of the chair back forward and then sliding the chair back vertically to a desired position.

Yet another object of the present invention is to provide a chair back height adjustment mechanism which will not be readjusted by casual downward forces applied to the top of the chair back.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several view of the drawings.

The exemplifications set out herein illustrate a preferred embodiment of the invention in one form thereof and such exemplifications are not to be construed as limiting the scope of the disclosure or the scope of the invention in any manner.

DESCRIPTION OF A PREFERRED EMBODIMENT

Figure 1:
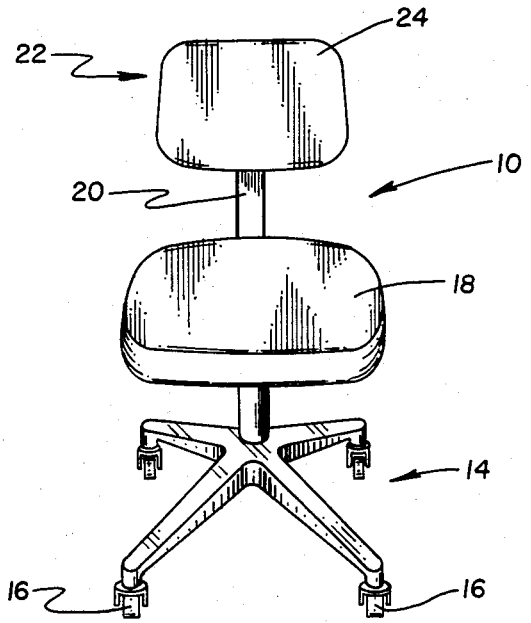
FIG. 1 is a perspective view of a chair according to the present invention.

Referring to FIG. 1 what is shown is a chair 10 including a base 14 including casters 16. A seat 18 and support column are supported by base 14. A back support column 20 supports a back 22 including a back cushion 24.

Figure 4:
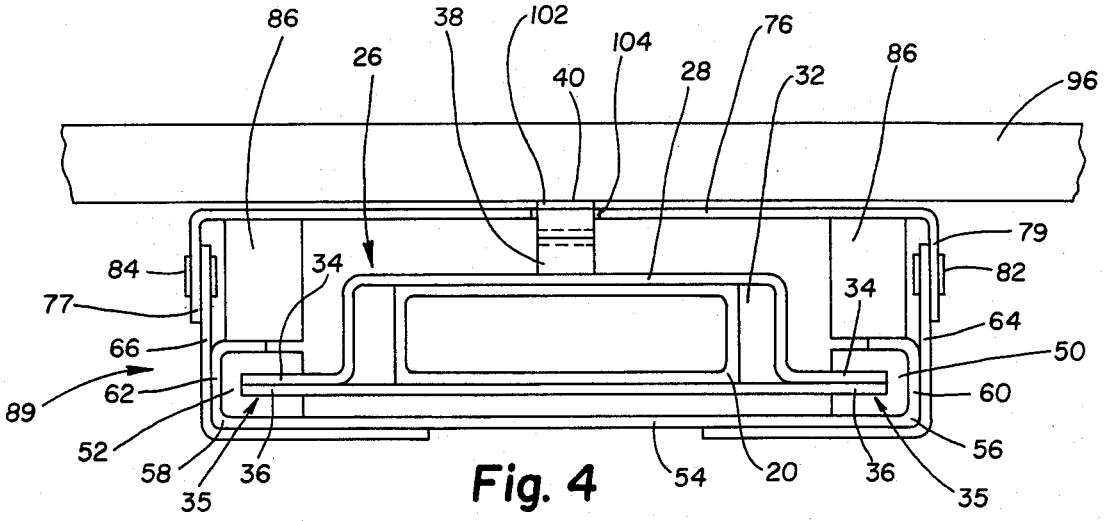
FIG. 4 is a sectional view taken along line 4—4 of FIG. 2.

Referring now to FIGS. 2 and 4–6 what is shown is an adjustment mechanism including a channel bracket 26 comprising two bracket members 28 and 30. Bracket member 28 includes flanges 34 and bracket member 30 includes flanges 36. Flanges 34 and 36 are secured to each other such as by spot welding to form flange members 35. Bracket members 28 and 30, form a channel 32 for receiving back support column 20 as best seen in FIG. 4.

Bracket 26 also includes a rack 38 which is secured to bracket member 28 by any suitable means such as by spot welding or fasteners. A locking device comprising a lock element in the form of rack 38 cooperates with a lock element in the form of gear 40 to retain the chair back in selected vertical position as further explained hereinafter.

Figure 5:
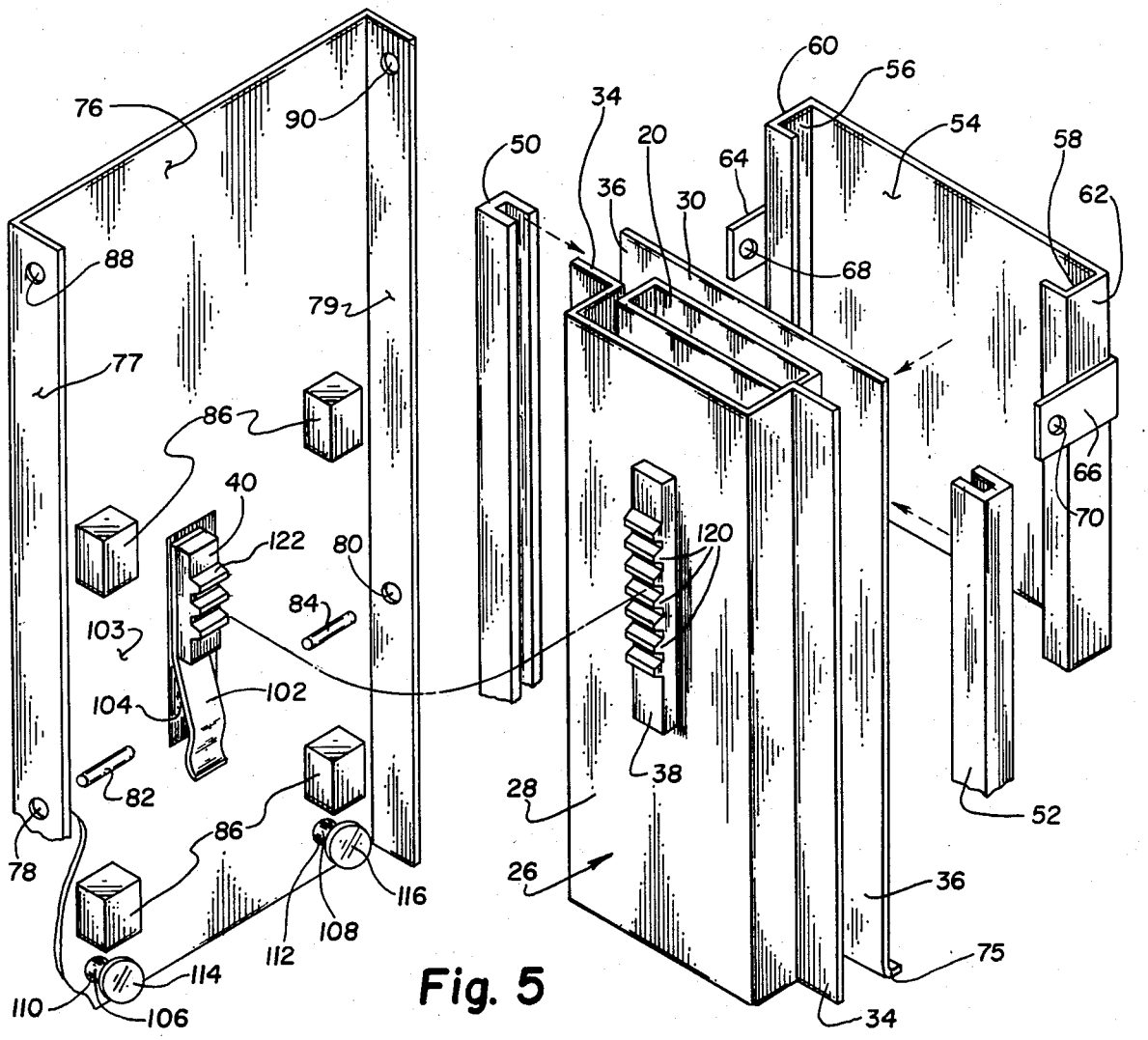
FIG. 5 is an exploded view of a preferred embodiment of the present invention.

Flanges 35 have press fitted thereon slides 50 and 52 respectively. Slides 50 and 52 cooperate with a sliding channel member 54 as best seen in FIG. 5. Channel member 54 includes bights 60 and 62 which form channels 56 and 58 respectively and which cooperate respectively with slides 50 and 52. Thus channel member 54 is vertically slidable on slides 50 and 52. Channel member 54 also includes two hinge brackets 64 and 66 which are secured to channel member 54 by any suitable means such as spot welding. Hinge brackets 64 and 66 include hinge apertures 68 and 70 as best seen in FIG. 5.

Bracket member 30 of channel bracket 26 includes an aperture 72 for receiving a stop 74. Stop 74 limits the upward travel of channel member 54 as further explained hereinafter. Bracket member 30 of channel bracket 26 also includes a flange member 75 which operates as a stop to limit the downward travel of channel member 54 as further explained hereinafter.

A U-shaped channel member 76 is provided to cooperate with sliding channel member 54 for providing the self adjusting tilting function for the chair back. Tilting channel member 76 includes flanges 77 and 79 as best seen in FIGS. 4 and 5. Flanges 77 and 79 respectively include hinge apertures 78 and 80. Hinge aperture 78 of flange 77 and hinge aperture 70 of bracket 66 receive a hinge pintle 82. Hinge aperture 68 of hinge bracket 64 and hinge aperture 80 of flange 79 receive a hinge pintle 84. Thus channel member 76 can pivot about hinge pintles, 82 and 84 about a horizontal axis located in the vicinity of gear 40 and rack 38. The hinging movement of channel member 76 is limited by means of stop blocks 86 as best shown in FIG. 5. Stop blocks 86 are preferably constructed of a resilient material such as foam rubber whereby a resilient stopping action is provided to limit the tilting movement of channel member 76. It can also be seen that by the securement of U-shaped tilting channel member 76 by means of hinge pintles 82 and 84 to sliding channel member 54, channel members 54 and 76 are constrained to move upwardly and downwardly together as they slide on slides 50 and 52. Channel members 54 and 76, slides 50 and 52 and brackets 62 and 64 form a carrier 89 that both slides and pivots on post assembly 20, 30 and 34.

Figure 2:
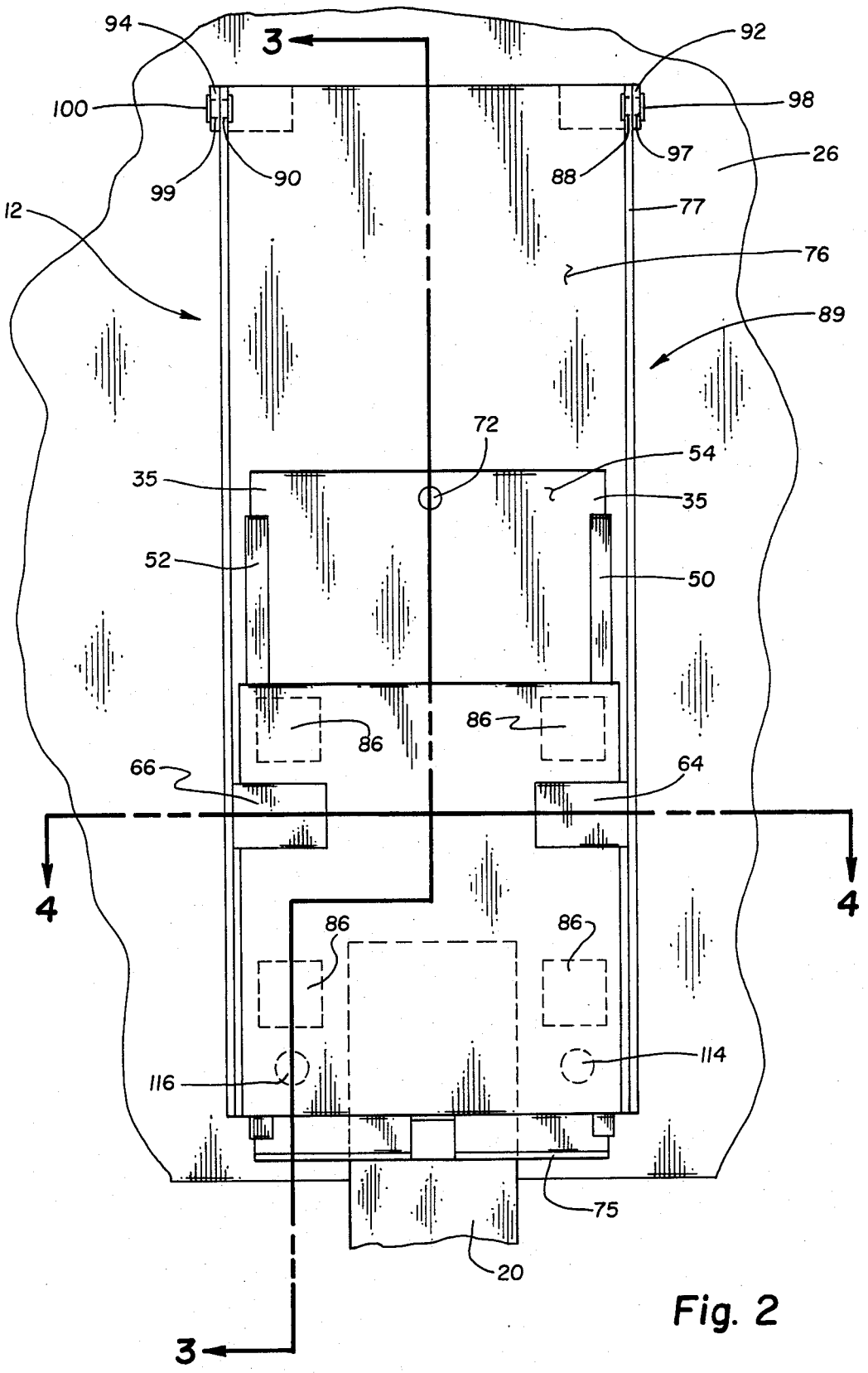
FIG. 2 is a rear elevational view of the height adjustment mechanism according to a preferred embodiment of the present invention.
Figure 6:
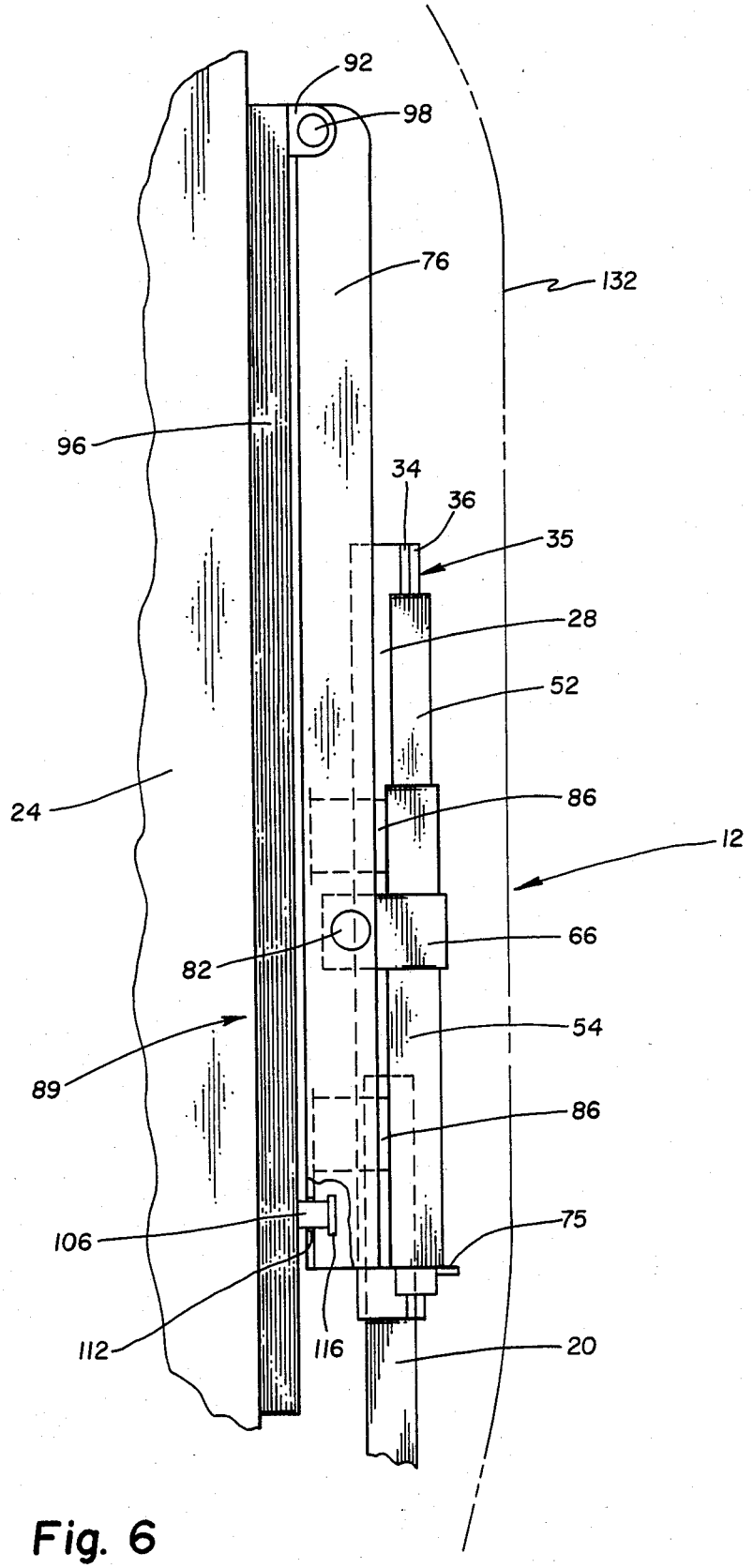
FIG. 6 is a fragmentary, side elevational view of a preferred embodiment of the present invention.

Flanges 77 and 79 of channel member 76 also include further hinge apertures 88 and 90 respectively. These hinge apertures cooperate with a pair of hinge apertures 97 and 99 in hinge brackets 92 and 94. Hinge brackets 92 and 94 are secured to a back panel 96 by means of any suitable fastening method such as spot welding as best seen in FIGS. 2 and 6. Hinge pintles 98 and 100 are provided to cooperate with the hinge apertures in hinge brackets 92 and 94 and flanges 77 and 79 respectively, so that back panel 96 is pivotable about a horizontal axis at the upper end of channel member 76. Back panel 96 forms part of chair back 22 and has a back cushion 24 secured thereto.

It can therefore be seen that back panel 96, tilting channel member 76 and sliding channel member 54 move together as a unit in the vertical direction, while back panel member 96 is pivotable about tilting channel member 76 and channel member 76 in turn is pivotable about sliding channel member 54. The purpose of these pivoting and sliding movements and the operation thereof will be further explained hereinafter.

Figure 3A:
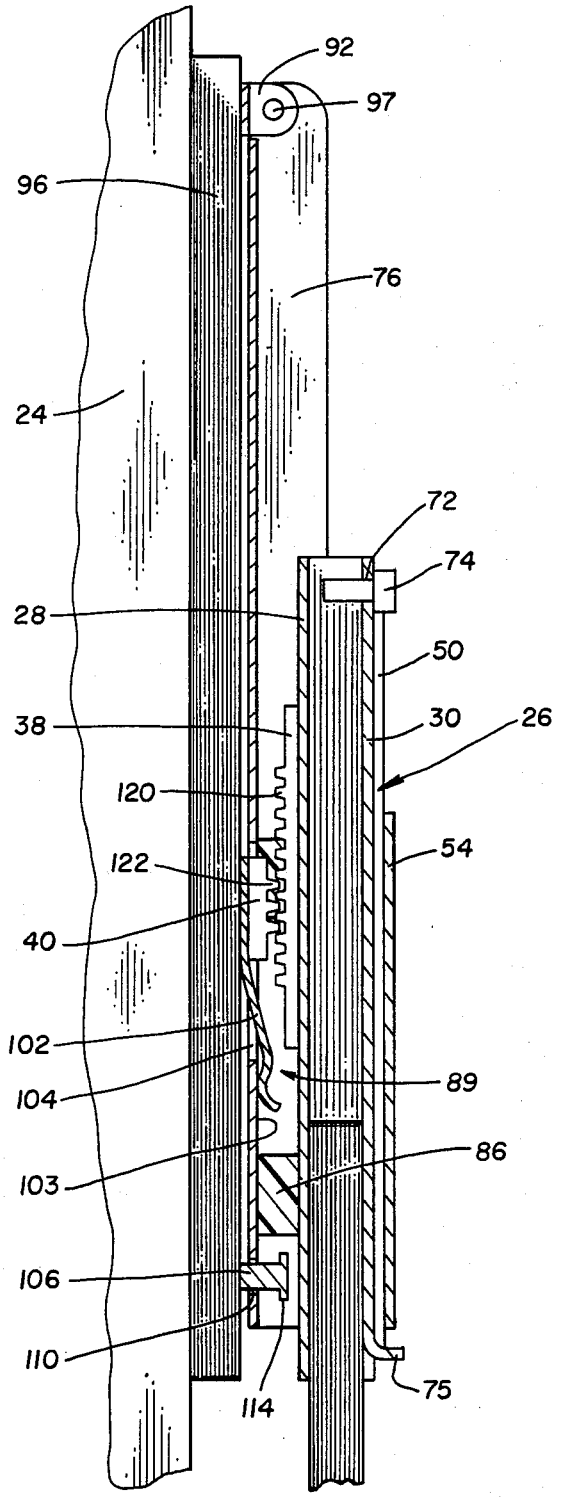
FIG. 3A is a broken-away, sectional view taken along line 3—3 of FIG. 2 and viewed in the direction of the arrows and with the adjustment mechanism in the locked mode.
Figure 3B:
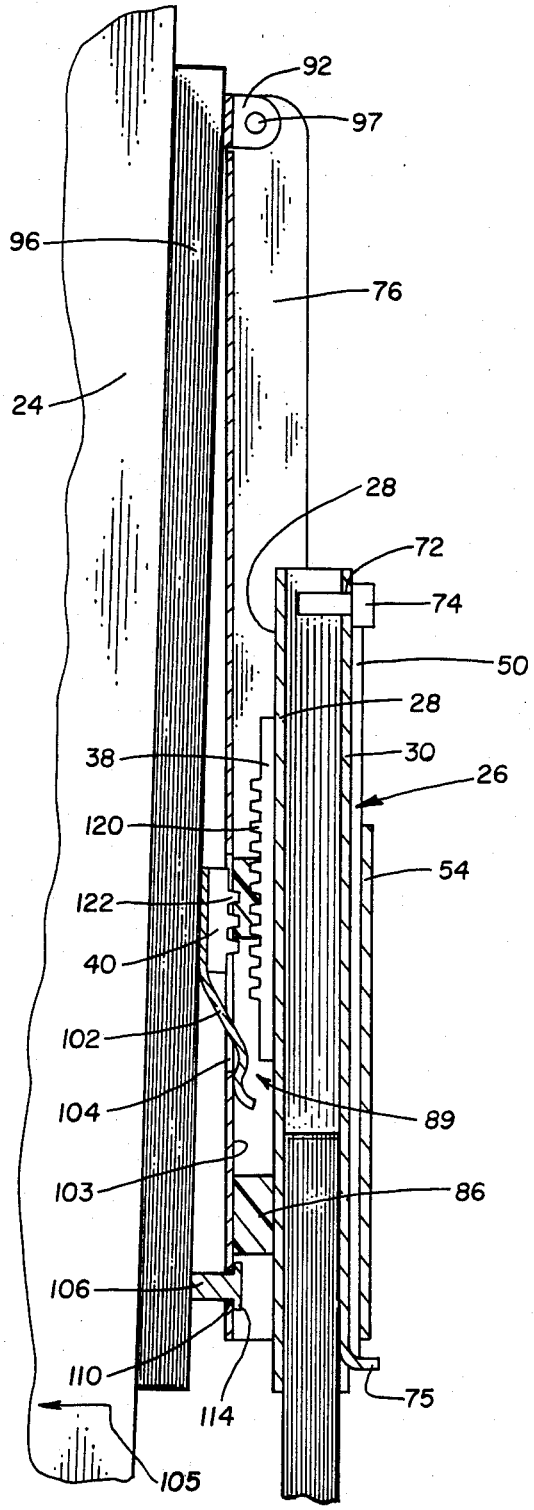
FIG. 3B broken-away, sectional view taken along line 3—3 in FIG. 2 and viewed in the direction of the arrows and with the adjustment mechanism in the released mode.

Continuing further with FIGS. 2 and 4–6, back panel 96 has secured thereto a back cushion 24. Channel 76 includes an aperture 104 through which extend a spring 102 and gear member 40, both of which are secured to back panel 96 as best shown in FIGS. 3A and 3B. Spring 102 cooperates with surface 103 of channel member 76 to provide spring biasing action to normally urge gear 40 into engagement with rack 38 as best illustrated in FIG. 3A. When the bottom edge of back 22 is moved forwardly in the direction of arrow 105 as shown in FIG. 3B, the forward force will cause the spring bias force of spring 102 to be overcome so that gear 40 disengages from rack 38. In this position back panel 96, tilting channel member 76 and sliding channel member 54 can move upwardly or downwardly together in a vertical travel path limited by stops 74 and 75. Surface 103 of channel member 76 also includes apertures 110 and 112. Stop members 106 and 108 are secured to back panel 96 and are disposed respectively in apertures 110 and 112. Head portions 114 and 116 on stops 106 and 108 respectively cooperate with surface 103 to limit the forward travel of back 24.

Figure 7:
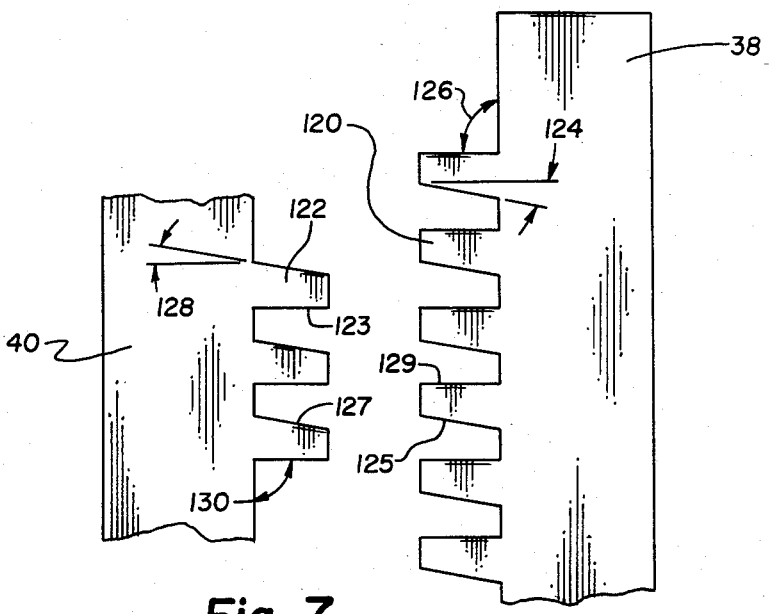
FIG. 7 is an enlarged, exploded side elevational view of the gear and rack members shown in FIG. 6.

By referring now to FIGS. 3A, 3B and 7 the operation of the mechanism is as follows: Normally spring 102 urges gear member 40 into engagement with rack 38. In this position the slots formed by teeth 122 of gear 40 cooperate with teeth 120 of rack 38 to prevent vertical adjustment of back 22. It can be seen that the lower surfaces 123 of teeth 122 of gear 40 extend at right angles with respect to the path of travel of gear 40. Lower surfaces 123 of teeth 122 on gear 40 cooperate with upper surfaces 129 of teeth 120 of rack member 38. Surfaces 129 also extend at right angles to the direction of travel of gear 40. There is therefore no tendency of gear 40 to slide out of engagement with rack 38. If more positive engagement were desired, a slight angle of inclination could be given to surfaces 123 and 129 whereby teeth 122 would would slide inwardly into teeth 120 of rack member 38. However, upper surfaces 127 of teeth 122 and lower surfaces 125 of teeth 120 are inclined at angles 128 and 126 respectively with respect to the direction of travel of gear 40, which angles are equal. Therefore if an upward force is applied to the lower edge of back 22 there is a tendency for teeth 122 to disengage with teeth 120 whereby the upward adjustment of back 22 is made easier. However, if a downward force is applied to the top portion of back 22 there is no tendency for teeth 120 to disengage from teeth 122 and back 22 will therefore retain its normal position as shown on FIG. 3A.

However, if a forward force in the direction of arrow 105 as shown in FIG. 3B is applied to the lower edge of back 22, back panel 96 will pivot about the pivot pins 98 and 100 at its upper end and teeth 122 will disengage from teeth 120 so that back 22 can be slid upwardly or downwardly as it moves on slides 50 and 52. When the desired vertical position of the back is reached the chair occupant lets go of back 22 so that teeth 122 can reengage with teeth 120 whereby the back is secured in its selected vertical position. This vertical adjustment of back 22 is relatively easy to make by an occupant of the chair by sitting slightly forward on the seat and simply reaching down and backwards to grasp the lower edge portion of the chair back and pulling it forward. Therefore the adjustment of the chair back is made very simple and convenient and will not require the occupant to leave the chair. The entire mechanism 12 can be covered with a suitable cover 132 whereby the mechanism would be concealed and will not collect dust and dirt.

The pivoting movement of chair back 22 about pivot pins 82 and 84 permits self adjusting tilting movement of the chair back 22 to portion the back 22 at an angle of greatest comfort for the chair occupant.

While this invention has been described as having a preferred design it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A chair comprising:

a base, a seat and a support column connected to one of said base and seat, a carrier slidably connected to said column, a back panel, first pivot means secured to an upper portion of said back panel for pivotally connecting said panel to said carrier for limited rotation about a first pivot axis, locking means comprising a first locking element on said back panel selectively engageable with a second locking element on said support column when the panel is rotated about the first pivot axis to a locked position to thereby lock the panel and carrier in a selected vertical position, said first and second lock elements disengaging when the panel is rotated about the first pivot axis to a release position wherein the panel and carrier can be moved vertically relative to said support column, biasing means operatively associated with said panel for yieldably urging said panel towards its lock position to cause engagement of said first and second lock elements, and second pivot means for pivotally connecting said carrier to said support column for rotation about a second pivot axis, said second axis being located below the first axis and in proximity to said locking means.

2. The chair of claim 1 wherein said locking means comprises selectively interengaging teeth on said back panel and support column.

3. The chair of claim 2 wherein said biasing means comprises spring means on said panel for urging said teeth into engagement.

4. The chair of claim 1 wherein said locking means comprises a projection on one of said back panel and said support column and a depression on the other of said back panel and support column, and said biasing means comprises a spring connected to said panel for urging said projections and depression into locking engagement.

5. The chair of claim 4 wherein said spring means is connected also to said carrier and urges said back panel toward said carrier.

6. The chair according to claim 1 and including a covering panel secured to said back panel for concealing said carrier and locking means.

7. The chair according to claim 1 and including stop means secured to said support column for limiting the vertical movement of said back panel and carrier.

8. The chair according to claim 1 and including stop means connected to said back panel for limiting the pivoting movement of said back panel about the first pivot axis.

9. The chair of claim 1 wherein a lower edge of said back panel is moveable in a direction toward an occupant of the chair to disengage said lock elements and enable vertical adjustment of said back panel.

10. A chair comprising:

a base, a seat and a support column connected to one of said base and seat, a carrier slidably connected to said column, a back panel, first pivot means secured to an upper portion of said back panel for pivotally connecting said panel to said carrier for limited rotation about a first pivot axis.

locking means comprising a first lock element on said back panel selectively engageable with a second locking element on said support column when the panel is rotated about the first pivot axis to a lock position to thereby lock the panel and carrier in a selected vertical position, said first and second lock elements disengaging when the panel is rotated about the first pivot axis to a release position wherein the panel and carrier can be moved certically relative to said support column, biasing means operatively associated with said panel for yieldably urging said panel towards its lock position to cause engagement of said first and second lock elements, said carrier comprising a first channel member slidably connected to said support column, a second channel member and a second pivot means for connecting said second channel member to said first channel member for pivoting movement about a second horizontal axis, said second axis being located below said first axis at a level in proximity to said locking means, vertical stop means on said carrier and column for limiting the vertical movement of said carrier and back panel, and stop means on said panel and carrier for limiting the rotating movement of said back panel.

11. The chair of claim 10 including carrier stop means associated with said carrier for limiting the rotating movement of said carrier with respect to said support column.

12. The chair of claim 11 wherein said carrier stop means is resilient.

13. The chair of claim 10 wherein a lower edge of said back panel is moveable in a direction toward an occupant of the chair to disengage said lock elements and enable vertical adjustment of said back panel.

14. The chair of claim 10 wherein said locking means comprises selectively interengaging teeth on said back panel and support column.

15. The chair of claim 10 wherein said locking means comprises a projection on one of said back panel and said support column and a depression on the other of said back panel and support column, and said biasing means comprises a spring connected to said panel for urging said projections and depression into locking engagement.

16. The chair of claim 10 wherein said carrier includes an opening therein in alignment with said first lock element, and said first lock element extends through said opening to engage said second lock element when said back panel is in its lock position.

17. The chair according to claim 10 wherein said biasing means is a spring that is secured to said back panel and engages a surface of said carrier to urge the panel and carrier together and cause engagement of the lock elements.

18. A chair comprising:

a base, a seat and a support column connected to one of said base and seat, a carrier connected to said column, a back panel pivotally connected to said carrier at a first pivot axis located on an upper portion of said back panel, said panel being vertically moveable with respect to said support column, locking means connected to said panel for locking said back panel at a selected vertical height on said column when a lower edge of said panel is rotated to a lock position and disengaging the panel from the column for vertical adjustment when the lower edge of the panel is rotated to a release position, means for biasing said panel toward the lock position, and means for pivotally connecting said carrier to said support column for rotation about a second pivot axis located below said first axis to prevent disengagement of said locking means by casual movement of the back panel.

19. The chair of claim 18 wherein said second axis is located at a level in proximity to said locking means.

20. The chair of claim 19 wherein said carrier is slidably connected to said support column.

21. The chair of claim 18 wherein said biasing means comprises means for yieldably biasing said panel toward the locked position.

* * * * *

UNITED STATES PATENT AND TRADEMARK OFFICE

CERTIFICATE OF CORRECTION

PATENT NO. : 4,616,877

DATED : October 14, 1986

INVENTOR(S) : Mathew A. Slaats et al

It is certified that error appears in the above-identified patent and that said Letters Patent is hereby corrected as shown below:

Col. 4, line 34, after "3B" insert --is a--.

Claim 10, Col. 8, line 29, change "certically" to --vertically--

Signed and Sealed this

Seventeenth Day of February, 1987

*Attest:*

DONALD J. QUIGG

*Attesting Officer*

*Commissioner of Patents and Trademarks*